US010124939B2

(12) United States Patent
Hooker et al.

(10) Patent No.: US 10,124,939 B2
(45) Date of Patent: Nov. 13, 2018

(54) CAP

(71) Applicant: Sangobeg Limited, Broughty Ferry Angus (GB)

(72) Inventors: Kenneth Sinclair Hooker, Lichfield (GB); James Ross Morrison, Dundee Tayside (GB)

(73) Assignee: SANGOBEG LIMITED, Dundee, Angus (GB)

( * ) Notice: Subject to any disclaimer, the term of this patent is extended or adjusted under 35 U.S.C. 154(b) by 8 days.

(21) Appl. No.: 15/313,865

(22) PCT Filed: May 19, 2015

(86) PCT No.: PCT/GB2015/051459
§ 371 (c)(1),
(2) Date: Nov. 23, 2016

(87) PCT Pub. No.: WO2015/177526
PCT Pub. Date: Nov. 26, 2015

(65) Prior Publication Data

US 2017/0203888 A1 Jul. 20, 2017

(30) Foreign Application Priority Data

May 23, 2014 (GB) ..... 1409263.9

(51) Int. Cl.
*B65D 47/32* (2006.01)
*B65D 51/16* (2006.01)
(Continued)

(52) U.S. Cl.
CPC ..... *B65D 47/32* (2013.01); *B65D 9/04* (2013.01); *B65D 41/00* (2013.01); *B65D 51/16* (2013.01);
(Continued)

(58) Field of Classification Search
CPC ..... B65D 47/32; B65D 9/04; B65D 41/00; B65D 51/16; B65D 53/02; B65D 51/145
See application file for complete search history.

(56) References Cited

U.S. PATENT DOCUMENTS 3,283,942 A 11/1966 Collie
4,165,817 A 8/1979 Wengenroth et al.
(Continued)

FOREIGN PATENT DOCUMENTS

DE 102012209597 A1 12/2013
WO 94/16964 A1 8/1994
WO 99/61323 A2 12/1999

OTHER PUBLICATIONS

Anonymous "Rum Forum—View Topic—Cling Film Solution to Keep the Angel's Share Down", (Jun. 16, 2008), XP055205460, Retrieved from the Internet: URL:http://www.refinedvices.com/forums/viewtopic.php?f=22&t=183 [retrieved on Jun. 30, 2015], 4 pages.

(Continued)

*Primary Examiner* — Erik Kashnikow
*Assistant Examiner* — Chaim A Smith
(74) *Attorney, Agent, or Firm* — Drinker Biddle & Reath LLP

(57) ABSTRACT

A cap adapted to cover an end of a cask for maturation of a spirit, comprises a body having an outer plate and a flange extending from the outer plate, and an inner plate spaced from the outer plate. The inner plate lies between the outer plate and the end of the cask when the cap is in place on the end of the cask. A layered or ridged spacer can separate the plates, and can permit fluid transfer in the space between the plates. The inner plate can be resistant to vapor transfer, and can be pressed against the outer surface of the end of the
(Continued)

cask when the cap is in place on the end of the cask, and leaves an annular area of the end of the cask uncovered.

20 Claims, 8 Drawing Sheets

(51) Int. Cl.
*B65D 8/00* (2006.01)
*B65D 41/00* (2006.01)
*B65D 53/02* (2006.01)

(52) U.S. Cl.
CPC .... *B65D 53/02* (2013.01); *B65D 2543/00212* (2013.01); *B65D 2543/00231* (2013.01); *B65D 2543/00268* (2013.01); *B65D 2543/00314* (2013.01); *B65D 2543/00333* (2013.01); *B65D 2543/00537* (2013.01); *B65D 2543/00629* (2013.01); *B65D 2543/00685* (2013.01); *B65D 2543/00759* (2013.01); *B65D 2543/00805* (2013.01); *B65D 2543/00972* (2013.01); *B65D 2543/00981* (2013.01)

(56) References Cited

U.S. PATENT DOCUMENTS

| | | | |
|---|---|---|---|
| 4,500,010 | A | 2/1985 | Schutz |
| 4,607,759 | A | 8/1986 | Boetzkes |
| 4,625,890 | A | 12/1986 | Galer |
| 5,176,279 | A | 1/1993 | Campbell et al. |
| 6,019,240 | A | 2/2000 | Legeza |
| 6,401,957 | B1 | 6/2002 | Przytulla |
| D481,312 | S | 10/2003 | Martin et al. |
| D657,669 | S | 4/2012 | Collins |
| 8,181,408 | B1 | 5/2012 | Triglia |
| D696,113 | S | 12/2013 | Stein |
| D721,963 | S | 2/2015 | Finkbohner et al. |
| 9,027,772 | B2 | 5/2015 | Chen |
| D739,234 | S | 9/2015 | Antal, Sr. et al. |
| 2014/0166659 | A1 | 6/2014 | Antal, Sr. et al. |

OTHER PUBLICATIONS

International Search Report/Written Opinion dated Aug. 12, 2015 (PCT/GB2015/051459).
Search Report dated Jul. 10, 2014 (GB1409263.9).
Notice of Allowance dated Jun. 2, 2015 (JP2014-026487), 3 pages (and 2 pages translation).
Written Opinion of the International Searching Authority for PCT/GB2015/051459, dated Nov. 29, 2016, 8 pages.

CAP

FIELD OF THE INVENTION

This invention relates to a cap, particularly a cap for capping a cask or barrel, particularly a wooden cask containing an alcoholic beverage, particularly a spirit such as brandy or whisky.

BACKGROUND

During the maturation of spirits such as whisky, brandy etc, a certain amount of spirit, colloquially called "the angels' share" in the industry, is lost from the cask by the evaporation of the spirit through the material of the cask. It is estimated that approximately two % per year of the spirit within the cask is lost through the evaporation of the angels' share. Although the evaporation of the spirit from the cask during the maturation process represents an economic loss to the distiller, it is tolerated because attempts to reduce the amount of fluid evaporating from the cask have been detrimental to the quality of the remaining spirit produced.

Apart from the economic loss represented by the evaporation of the spirit from the cask, there are other disadvantages. Distilleries and other sites where spirits are matured are commonly affected by "blackening" of the surfaces of nearby buildings and other structures. This is caused by the accelerated growth of a naturally occurring fungus *Baudoinia compniacensis*, which thrives in environments rich in ethanol vapour.

SUMMARY OF THE INVENTION

The invention provides a cap adapted to cover an end of a cask for maturation of a spirit, the cap comprising a body having an outer plate and a flange extending from the outer plate, and an inner plate spaced from the outer plate, wherein the inner plate is disposed between the outer plate and the end of the cask when the cap is in place on the end of the cask.

The invention also provides a cask assembly, comprising a cask containing a spirit, a cap covering an end of the cask, the cap comprising a body having an outer plate and a flange extending from the outer plate, and an inner plate spaced from the outer plate, wherein the inner plate is disposed between the outer plate and the end of the cask.

Optionally the flange extends generally perpendicularly from the outer plate, optionally from a periphery of the outer plate, for example the circumference of the outer plate.

Optionally, the cap comprises at least one spacer between the outer plate and the inner plate. Optionally, the spacer comprises at least two spacer members. Optionally, the spacer members permit fluid transfer (for example the passage of vapour). Optionally the spacer members can incorporate channels to facilitate fluid (e.g. vapour) transfer through the spacer members. Optionally, at least one and optionally both of the spacer members comprises an annular ring. Optionally, the spacer members can each comprise partially annular components. Optionally, the annular rings can be concentric. Optionally, more than two spacer members can be provided. Optionally, the annular rings partially contain vapour within certain zones between the outer plate and the inner plate. Optionally, the annular rings permit a limited amount of vapour transfer between different zones between the outer plate and the inner plate, and optionally the rings limit the amount of vapour transfer between the different zones. Optionally the spacer members can be other shapes and do not need to be concentric rings, for example they can comprise discrete spacers arranged in a dispersed planar array between the inner and the outer plate.

Optionally the spacer members can have a layered construction, optionally being constructed from one or more layers. Optionally the surfaces of the spacer members which engage the inner and the outer plates (and optionally the surfaces which engage the different layers of spacer members) can have ridges, protrusions, corrugations or other formations, so that at least some of the surfaces of at least some of the spacer members are not planar, but incorporate corrugations on their surfaces. This can create channels to assist in the passage of fluid, for example vapour, through the material of the spacer members.

Optionally, the inner plate has a smaller surface area than the outer plate. Optionally, the outer plate has a larger surface area than the end of the cask. Optionally the surface area of the inner plate is smaller than the surface area of the end of the cask. Optionally, the inner plate and the surface area are generally annular. Optionally, the inner plate leaves an area of the end of the cask uncovered. Optionally, the uncovered area of the end of the cask comprises an annular ring radially outside the outer diameter of the inner plate, and radially inside the outer periphery of the cask, for example the rim of the cask. Optionally the inner and outer plates can be generally planar. Optionally the inner plate can be generally circular. Optionally the outer plate can be generally circular.

Optionally, the inner plate is pressed against the outer surface of the end of the cask when the cap is in place on the end of the cask.

Optionally, the inner plate can comprise a water resistant material, adapted to resist transfer of vapour across the inner plate. Optionally, the water resistant material can comprise a coating on one surface of the inner plate, for example the surface of the inner plate facing the end of the cask. Optionally, the inner plate can have two opposed surfaces, and optionally the water resistant material can be provided on each surface of the inner plate. Optionally the inner plate comprises a vapour barrier by virtue of the water resistant material, and resists diffusion of vapour through the inner plate, forcing fluid to migrate across the surface of the inner plate.

Optionally the cap comprises a collar, optionally forming part of the flange. Optionally the collar reinforces the flange. Optionally the collar can be connected to the body by adhesives, fixings, and/or inter-engaging formations on the collar and the body. Optionally, the inter-engaging formations on the collar and the body can comprise tabs and slots. Optionally, a tab on the body can engage within a slot on the collar, or vice versa. Optionally, the collar can comprise a plurality of wall segments.

Optionally the flange comprises a plurality of flange segments extending from the outer plate. Optionally, the flange segments are formed integrally with the outer plate, and hingedly attached to the outer plate, so that the flange segments can bend at the hinge into a perpendicular configuration relative to the outer plate. Optionally, the flange segments are arranged sequentially around the circumference of the outer plate, and adjacent flange segments on the circumference can optionally bend relative to one another. Optionally, the flange is formed by bending each flange segment on the circumference approximately 90° relative to the outer plate. Optionally, adjacent flange segments on the circumference are unconnected to one another, and may incorporate cut outs between adjacent flange segments.

Optionally adjacent flange segments are connected to contiguous points on the circumference of the outer plate, so that bending adjacent flange segments through 90° relative to the outer plate forms a continuous flange, the flange segments forming adjacent segments of the flange when bent through approximately 90° relative to the outer plate.

Optionally, each flange segment has a first portion and a second portion, with the hinge between them. Optionally the first portion of the flange segment is connected to the circumference of the outer plate. Optionally the second portion of the flange segment is connected to the first portion by the hinge. Optionally, the first and second portions of the flange segment can fold together around the hinge, and in one example of the invention, the collar can be disposed between the first and second portions of the flange segment. Optionally, the second portion of the flange segment comprises a tab adapted to engage in a slot on the collar.

Optionally the cap has a retainer mechanism comprising a catch adapted to cooperate with a hoop on the outer surface of the cask, to retain the cap on the end of the cask. Optionally, the retainer mechanism comprises at least one flap connected to the flange. Optionally, the retainer mechanism comprises a number of flaps connected to the flange, and spaced around the circumference of the cap. Optionally, when flaps are provided, not all of the flange segments on the cap necessarily incorporate a flap, and in some examples, the flaps could be disposed on only some of the flange segments, which are optionally spaced apart around the circumference of the flange, leaving one or more flange segments which do not incorporate flaps in between.

Optionally, the flap of the retainer mechanism is connected to the flange by a hinge allowing pivotal movement of the flap of the retainer mechanism relative to the flange. Optionally, the hinge is connected to a portion of the flange that is spaced away from the outer plate, optionally at the tip of the flange. Optionally, the retainer mechanism comprises a flap cut from the second portion of the flange segment. Optionally, the flap is resiliently biased relative to the flange. Optionally, the flap is resiliently biased in a radially inward direction relative to the cap. Optionally, the flap extends from the flange at an acute angle, and in one example of the invention, the distal (free) end of the flap extends radially inward from the flange, with the tip of the distal end pointing towards the surface of the outer plate.

Optionally, the flap is urged radially outward toward the flange by an end hoop on the cask, against the resilient bias of the flap, when the cap is placed over the end of the cask. The distal (free) end of the flap opposite the hinged end connected to the flange drags over the outer surface of the hoop and the cask, as the cap is pushed over the end of the cask, until the distal end of the flap traverses over the whole of the hoop, at which point, the resilient bias on the flap urges it radially inward relative to the hoop, so that the distal end of the flap hooks underneath the edge of the hoop, thereby retaining the cap in place on the end of the cask. Optionally, each flap that is circumferentially spaced around the circumference of the flange engages its distal end underneath the hoop at approximately the same axial location as the cap is pushed onto the end of the cask. Optionally, when the flaps engage underneath the hoop, optionally at intervals circumferentially spaced around the hoop, the inner plate is pushed onto the end surface of the cask.

Optionally, the cap is formed from a breathable material, permitting a limited amount of vapour transport through the material of the cap. Optionally, the cap material comprises a pulped fibrous material, for example a pulped wood material such as fibreboard or cardboard. Optionally, the cap material limits the amount of vapour able to pass through the material of the cap. Optionally, the material of the body and the inner plate can be different from the material of the spacer members. In certain examples, the material of the body and optionally the inner plate can be formed from compressed fibreboard, whereas the material of the spacer members can comprise cardboard, particularly corrugated cardboard.

Optionally the outer plate has a generally arcuate circumferential boundary formed by sequential straight lines set at obtuse angles (optionally the same angle) around the circumference. In one example, the outer plate has 16 straight sides sequentially connected at the circumference. While each of the 16 straight sides is linear, the general arrangement of the whole circumference is generally arcuate. More or less than 16 sides can be used in different examples. For example, any number of sides from 8 to 20 can provide a suitably arcuate circumference for the outer plate. If more sides are provided on the circumference, the circumference will more accurately approach a true arcuate arrangement. The number of sides optionally corresponds to the number of segments of the flange.

The collar is optionally compressed between the flange and the outer plate, and optionally resists passage of vapour between adjacent flange segments, because the collar optionally extends generally continuously between adjacent flange segments.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can optionally be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. Any subject matter described in the specification can be combined with any other subject matter in the specification to form a novel combination. The invention is also capable of other and different examples and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described and are not to be interpreted as limiting the invention to the literal interpretation of the term, but instead should be as understood by the skilled addressee.

DETAILED DESCRIPTION OF EXAMPLES OF THE INVENTION

Figure 1:
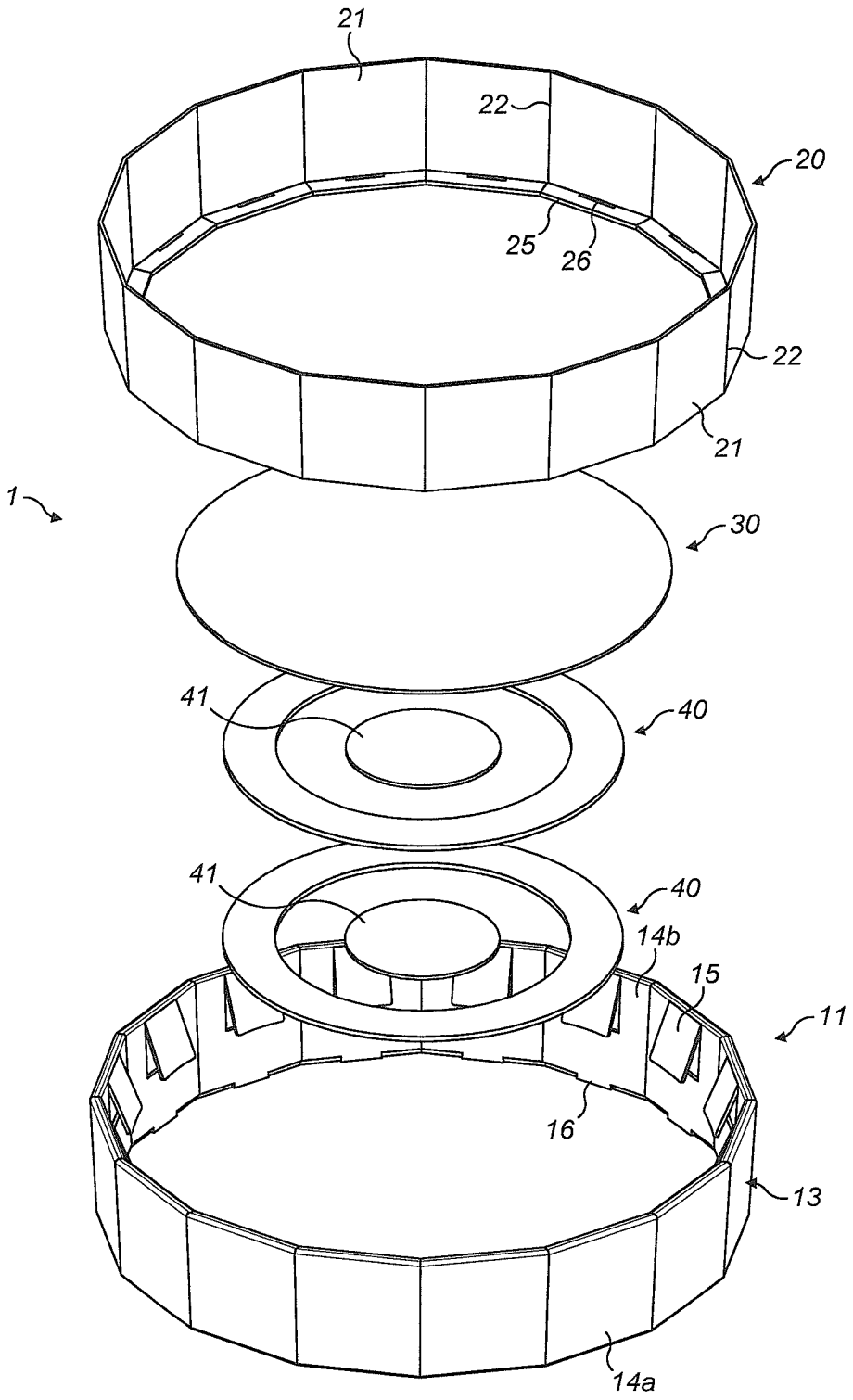
FIG. 1 shows an exploded view of a cap illustrating the different components.
Figure 2:
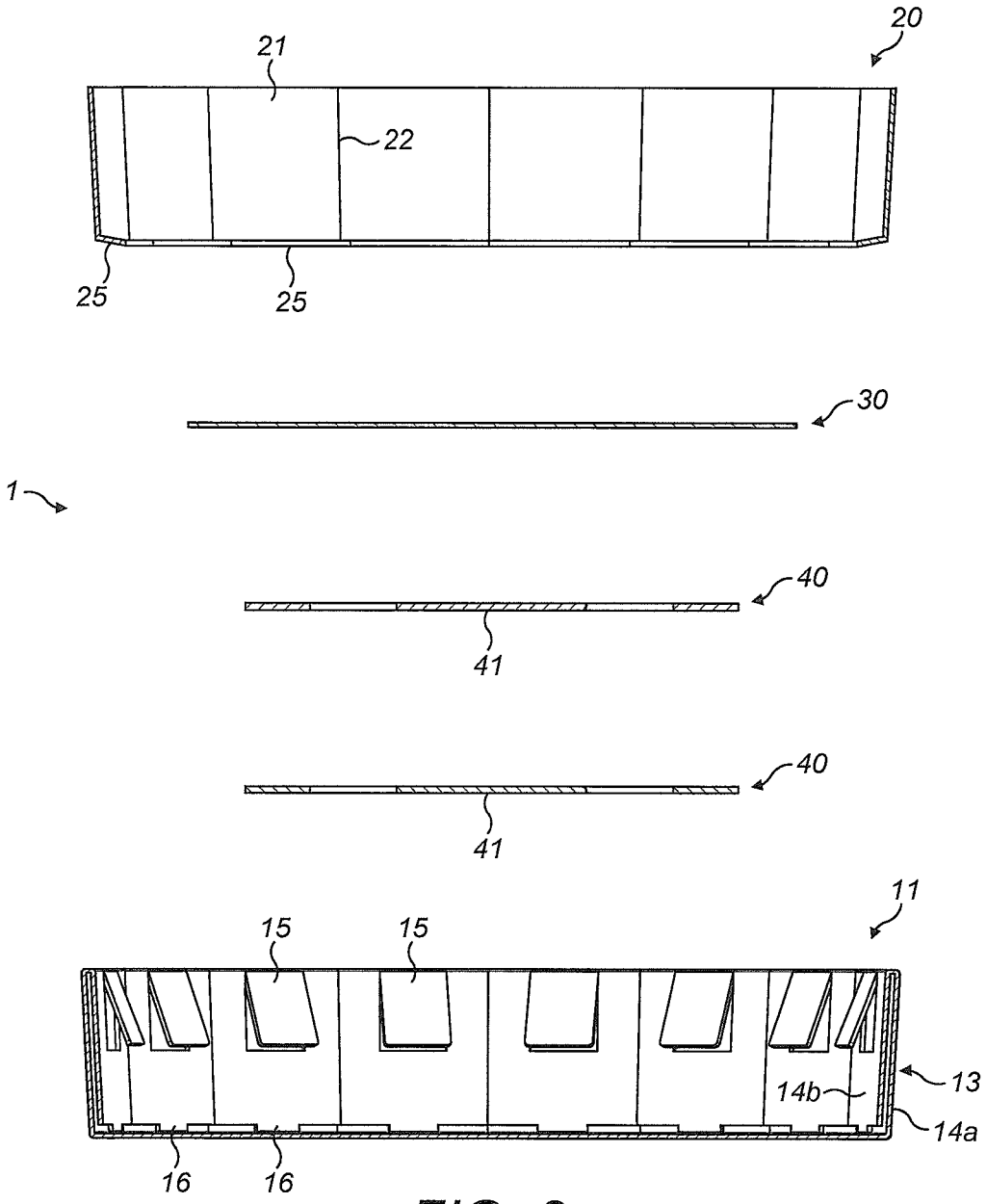
FIG. 2 shows an exploded view similar to FIG. 1, with a sectional view through the different components.
Figure 3:
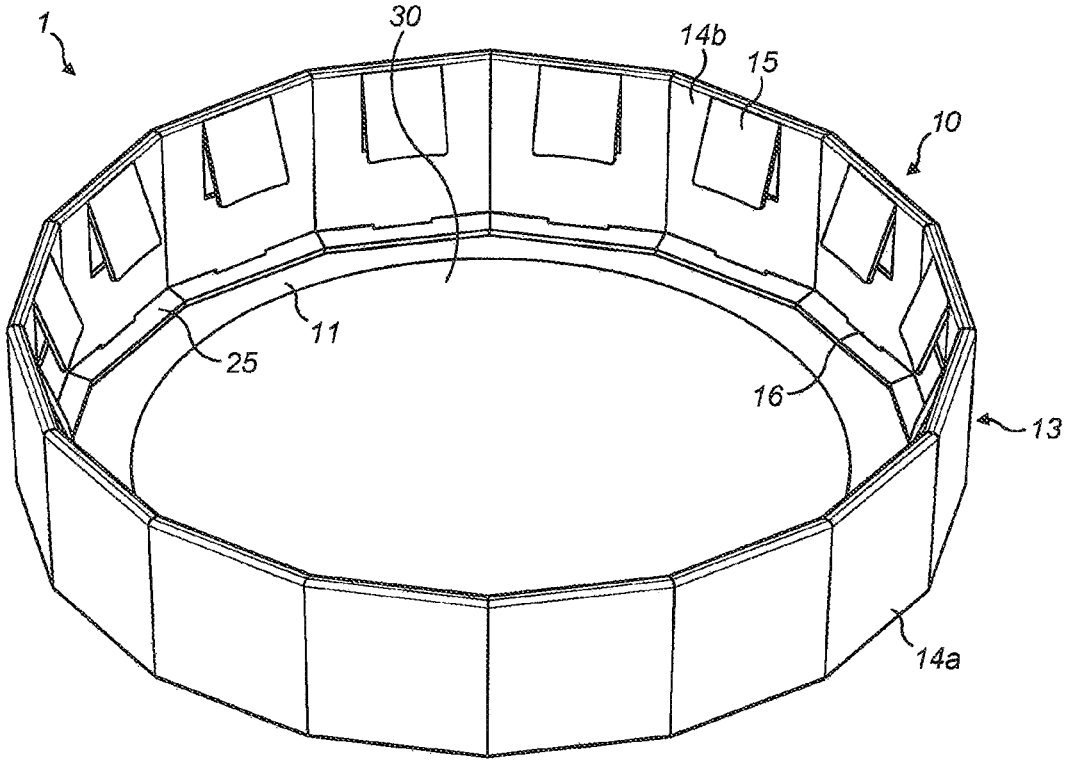
FIG. 3 shows a perspective view of the cap.
Figure 4:
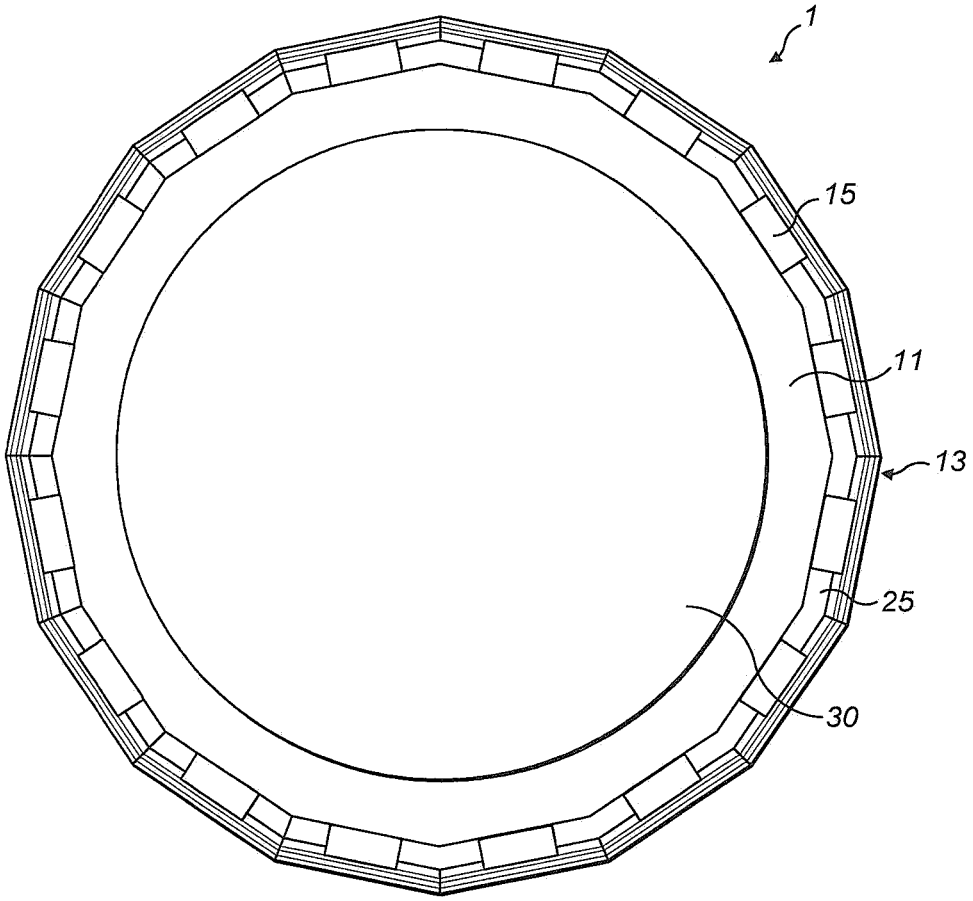
FIG. 4 shows a plan view of the inside of the cap.
Figure 5:
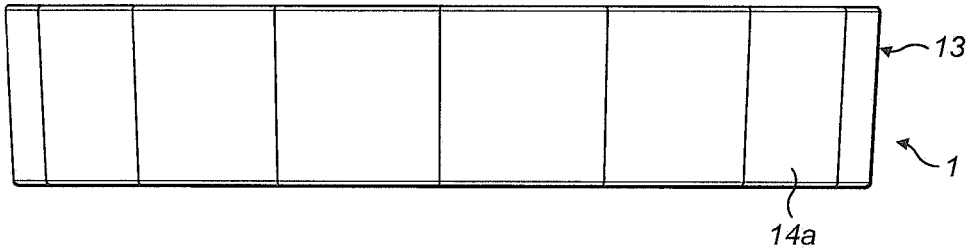
FIG. 5 shows a side view of the cap.
Figure 6:
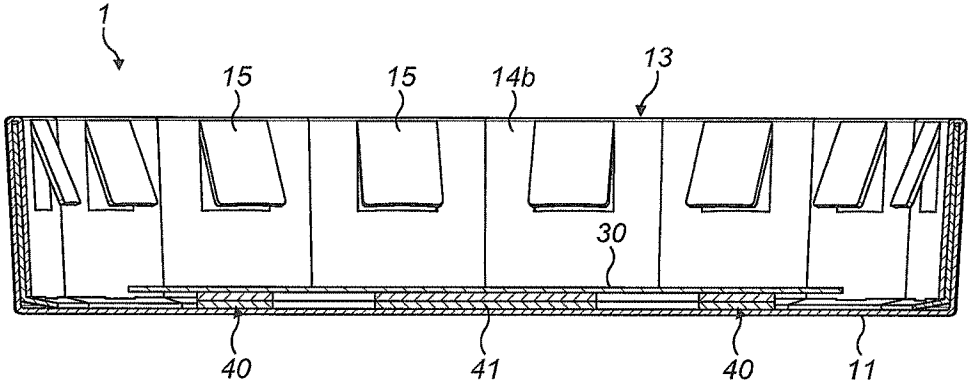
FIG. 6 and FIG. 7 shows sectional views from the side.
Figure 7:
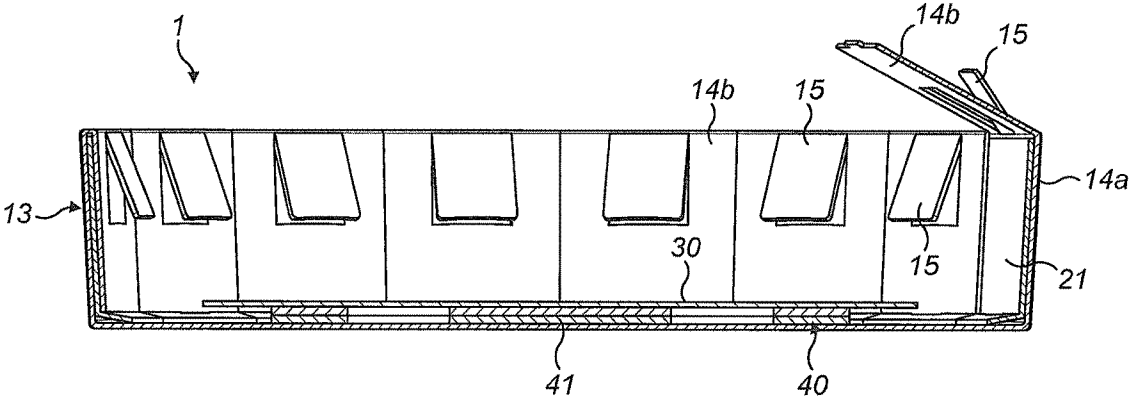

Referring now to the drawings, a cap 1 comprises a body 10 having an outer plate 11 at one end of the body, the outer plate 11 having a planar inner surface. A flange 13 extends generally perpendicularly from the planar inner surface of the outer plate 11. A collar 20 supports the flange 13 as will be described below. The cap has a disc 30 arranged generally parallel to the outer plate 11, and spacers 40, 41 disposed between the outer plate 11 and the disc 30, which space the disc 30 from the outer plate 11. In this example, the spacers 40, 41 comprise multiple layers, e.g. two layers bonded together. The outer plate 11, the collar 20 and optionally the disc 30 are all optionally made from high density compressed fibreboard or high-density cardboard or the like, which has optionally been treated to increase its resistance to the passage of vapour through the material. Optionally the spacers 40, 41 can be made from the same material, but in the present embodiment, they can optionally comprise a less dense material, such as corrugated cardboard, as will be described below.

Figure 10:
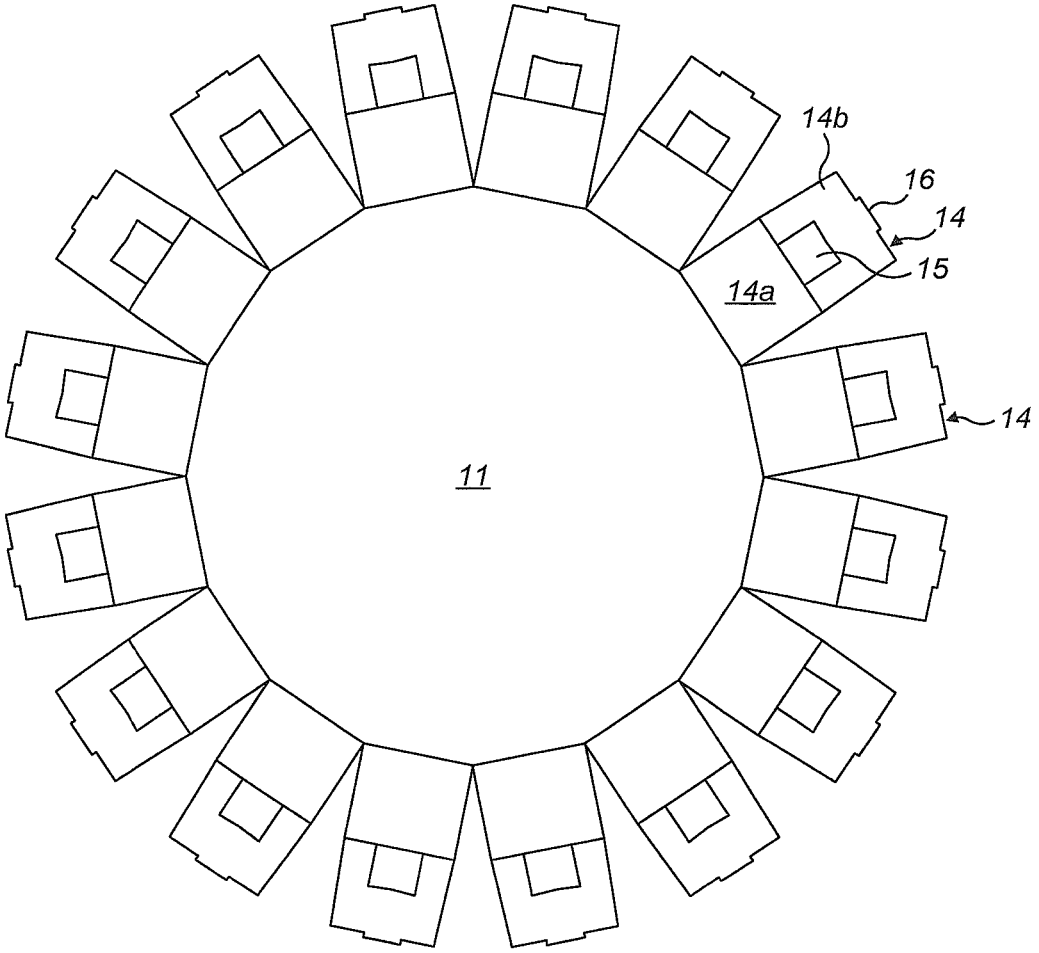
FIG. 10 shows a blank of a portion of a body of the cap.

The body 10 components are optionally cut in a single piece from a sheet material, for example from compressed fibreboard or high-density cardboard. A blank of the outer plate 11 of the body is shown in FIG. 10. The outer plate 11 can in some examples have a generally circular circumference, but in this example, the circumference of the outer plate 11 is a polyhedron. Outer plate 11 optionally has 16 flat sides. Optionally the 16 sides of the circumference need not be flat, and could be arcuate, and in fact the whole outer plate can have a generally circular circumference, but it is convenient for bending operations and other manufacturing processes that the sides are generally flat. Different examples can have different numbers of sides.

At each side on the circumference of the outer plate 11, the material of the body is scored or creased or otherwise treated or constructed to form a hinge between the outer plate 11 and a flange segment 14, allowing the flange segment to bend, e.g. at right angles relative to the flat surface of the plate 11. Flange segments 14 are formed by cutting V shaped inserts from the material of the blank shown in FIG. 10.

Flange segments 14 bend perpendicularly to the outer plate 11 in order to form separate segments of the flange 13 as will be described below. Each flange segment 14 comprises a first portion 14*a*, connected to the outer plate 11 by the hinge, and a second portion 14*b*, which is connected to the first portion 14*a* by a similar hinge, which can comprise a weakened, folded, scored or perforated region of the material. Thus, in the two-dimensional blank of the outer plate 11 as shown in FIG. 10, the first portion of the flange segment 14*a* is disposed between the outer plate 11, and the second portion of the flange segment 14*b*, with hinges on either side of the first portion 14*a*.

The second portion of the flange segment 14*b* incorporates a flap 15. The flap 15 is attached to the flange segment 14 at only one edge of the flap, at the hinge between the first and second portions 14*a*, 14*b*. The remaining edges of the flap 15 are not connected to the flange segment 14. Thus, the hinge between the first portion 14*a* and second portion 14*b* of the flange segment 14 permits pivotal movement of the second portion 14*b* and of the flap 15 relative to the first portion 14*a* of the flange segment 14. In addition to being pivotally movable relative to the first portion 14*a*, the flap 15 is pivotally movable relative to the second portion 14*b* of the flange segment 14. Thus, the flap 15 is pivotally movable relative to the whole of the flange segment 14.

At the furthest extent of the second portion 14*b* of the flange segment 14, the second portion 14*b* incorporates a tab 16 extending from the central position on the radially outer edge of the second portion 14*b* of the flange segment 14. The tab 16 locates in a notch in order to assemble the cap as will be described below.

Figure 11:
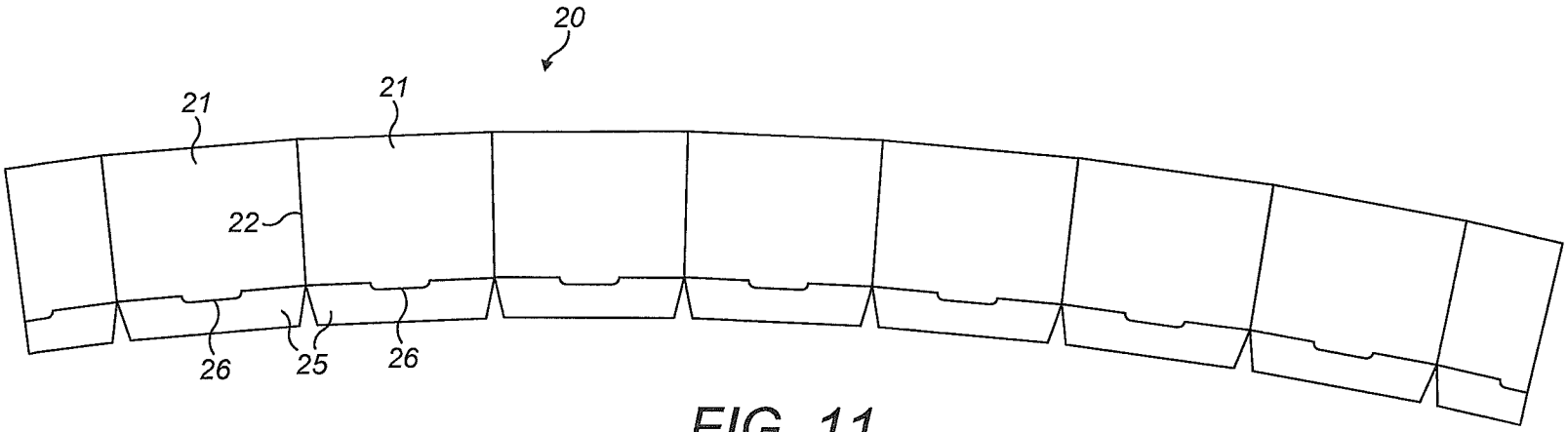
FIG. 11 shows a blank of a collar of the cap.

The collar 20 is optionally cut from a flat sheet of material in the same way as the outer plate 11, and a blank of the collar 20 is shown in FIG. 11. The collar 20 reinforces the flange 13, and incorporates a sequential arrangement of wall segments 21 interconnected by hinges in the form of creases 22, permitting pivotal movement of the adjacent wall segments 21 relative to one another. Optionally, the creases 22 are relatively stiff, and only permit a relatively small amount of relative pivotal movement between adjacent wall segments 21, and merely constitute a location in the collar 20 at which the collar 20 is preferentially configured to bend when formed into shape in the assembled cap 1. The creases 22 are spaced along the collar 20 at a spacing that is roughly equivalent to, or is substantially equal to, the length of the sides of the polyhedron forming the outer plate 11 of the body 10. In use, the collar 20 is formed into a generally circular shape, following the line of the circumference of the outer plate 11, so that the creases 22 line up at the corners of the straight edges of the polyhedron forming the circumference of the outer plate 11.

The collar 20 also incorporates a small flap 25 connected to the base of each wall segment 21. Each flap 25 incorporates a notch 26 formed along the central portion of a crease line between the flap 25 and the wall segment 21. The crease line forms a hinge between the flap 25 and the wall segment 21, allowing relative pivotal movement between the two components. The relative pivotal movement allowed by the crease line is relatively small, because the hinge formed by the crease line is relatively stiff, and like the creases 22, the crease line between each flap 25 and its respective wall segment 21 helps to define the point at which the flap 25 will bend relative to the wall segment 21, so that the notch 26 lies along the same line, at the interface between the flap 25 and the wall segment 21.

The collar 20 is assembled with the body as follows: initially, the flange segments 14 are bent upwardly relative to the outer plate 11 on the body 10 around the hinge between the first portion 14*a* and the outer plate 11, so that the two portions 14*a*, 14*b* of the flange segments 14 are aligned, and extend perpendicularly with respect to the outer plate 11. When the flange segments 14 are bent upwardly in this manner, along the hinge between the first portion 14*a* and the outer plate 11, the adjacent edges of the flange segments 14 move into contact with one another to close the gaps between them at the corners of the flat lines forming the polyhedron constituting the circumference of the outer plate 11. At that point, the collar 20 is attached to the body by bending the flaps 25 to approximate right angles to the wall segments 21, and by bending the wall segments 21 relative to one another to follow the polyhedron constituting the circumference of the outer plate 11. The flaps 25 have chamfered or angled adjacent side edges, which help to define the correct degree of bending of adjacent wall segments 21, and when adjacent wall segments 21 are aligned along the polyhedron on the circumference of the outer plate 11, the adjacent chamfered side edges of the flaps 25 abut one another. At this point, the back face of each wall segment 21 is disposed against the flat inner face of a respective first portion 14*a*, and the lower face of each flap 25 is disposed against the surface of the outer plate 11 at its periphery. Optionally, the collar 20 extends around the entire circumference of the outer plate 11, and the length of the collar 20 substantially equals the length of the circumference of the outer plate 11, so that the edges of the collar 20 meet one another when thus assembled. Optionally adhesive is applied to the opposing faces of the collar and the body in the described assembly, for example between the back face of each wall segment 21 and the flat inner face of each respective first portion 14*a* of the flange segment 14, and between the lower face of each flap 25 and the peripheral part of the outer plate 11. Optionally, adhesive can be applied between the abutting ends of the collar 20, which are optionally connected together at the middle of one of the flange portions 14.

Once the collar 20 has been attached to the first portion 14*a* of the flange segments 14, the second portion 14*b* of each flange segment 14 is then bent radially inwards towards the centre of the outer plate 11, over the inner face of each wall segment 21 of the collar 20. The tab 16 on each second portion 14*b* of each flange segment 14 is then located within a respective notch 26 at the crease line between the flaps 25 and the wall segments 21. Optionally, the second portion 14*b* can be glued in place, but in the present example, the location of the tab 16 in the notch 26 is sufficient to hold the arrangement in place. When thus assembled, the collar 20 is sandwiched between the first and the second portions 14*a*, 14*b* of each flange segment 14, and the gaps between adjacent flange segments 14 are closed by the continuous collar 20 which extends around the circumference of the outer plate 11. The adhesive between the flap 25 and the outer plate 11 and between the wall segment 21 and the first portion 14*a* on each flange segment 14 strengthens the whole arrangement, and retains the generally perpendicular arrangement of the flange 13 relative to the flat outer plate 11.

The flaps 15 optionally extend radially inwards from the crease line between the first portion 14*a* and the second portion 14*b* on each flange segment 14. Optionally each flap 15 points towards the centre of the outer plate 11, and adopts an angle relative to the flange 13 such that each flap points towards the outer plate 11, and forms an acute angle with the flange 13. The precise angle formed between the flaps 15 and the flange 13 is not particularly important, and need not be consistent between the flaps on any particular example, but it is useful that in each case, the flaps 15 are arranged at some acute angle so that their free ends opposite the crease line between the first and second portions 14*a*, 14*b* point at an angle towards the flat surface of the outer plate 11. Note that the angle adopted for the flaps 15 does not need to be consistent between different flaps 15.

The disc 30 is advantageously circular. The disc 30 has an outer face and an inner face. The inner face opposes the outer plate 11, and is spaced from the outer plate 11 by at least one and optionally two spacer devices in the form of spacers 40, 41. The spacers 40, 41 can optionally be provided as concentric rings, but in this example, comprise an inner spacer 40, and an outer spacer 41. The outer spacer 41 optionally takes the form of a flat annular ring, and the inner spacer optionally takes the form of a flat annular disk. The spacers 40, 41 space the end plate of the disc 30 opposing surface of the outer plate 11 on the body 10. The spacing between the disc 30 and the outer plate 11 can be varied in different examples of the invention, but in this case, the spacing is approximately 10 to 15 mm.

Optionally, the material used to form the spacers 40, 41 comprises a porous material, optionally provided with channels to promote passage of vapour and other fluids through the spacers 40, 41. One useful material, which forms the spacers 40, 41 in this example, is corrugated cardboard. In this example, the surfaces of the individual layers of the spacers 40, 41 are corrugated in order to permit channels passing radially through the spacers 40, 41 in different directions. Accordingly, fluid vapour between the disc 30 and the outer plate 11 can readily travel in a radial direction through the spacers 40, 41, i.e. the spacers promote transmission of fluid vapour. As previously noted the spacers 40, 41 are formed in a layered structure, having two or more layers.

Optionally the outer surface of the disc 30 is coated, optionally with a waterproof material such as a foil material. Optionally, each of the outer and end plates of the disc 30 is so coated. In this example, each of the outer and end plates of the disc 30 is covered with a foil material. The foil material resists passage of vapour through the material of the disc 30.

Optionally, the diameter of the disc 30 is less than the diameter of the outer plate 11, so that there is a gap between the outer periphery of the disc 30 and the circumference of the outer plate 11. The gap can vary in distance in different examples of the invention, but in this example, the annular gap between the periphery of the disc 30 and the circumference of the outer plate 11 is approximately 5 to 10 cm.

The flaps 15 form a retainer mechanism providing a catch to retain the cap on the end of the cask C. The flaps 15 are resiliently biased in a radially inward direction relative to the cap, with the distal (free) ends of each flap 15 extending radially inward from the flange, pointing towards the outer plate 11.

Figure 9:
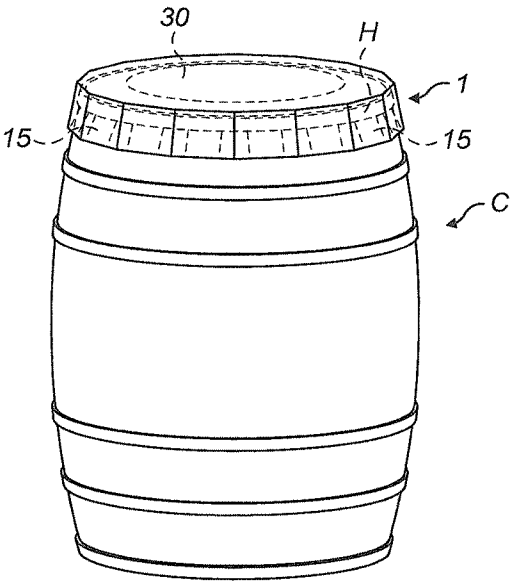
FIG. 9 shows the capped cask of FIG. 8.
Figure 8:
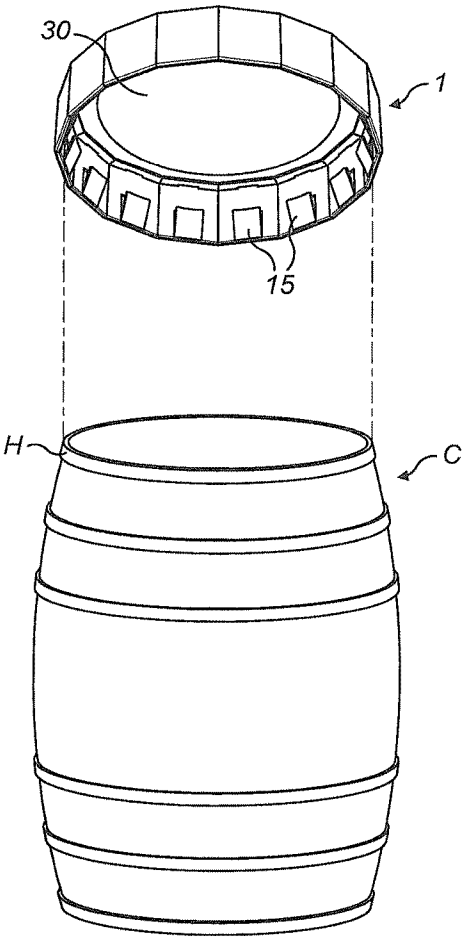
FIG. 8 shows a cask about to be covered at one end by the cap.

In use, the cap 1 is offered to the end of cask C containing the spirit to be matured as shown in FIG. 8, and is pressed over the end as shown in FIG. 9. The cask C is arranged on one end, with the upper end covered with the cap 1. The action of pushing the cap 1 down onto the cask C end urges each flap 15 radially outward back into line with the flange 13, against the natural resilient bias of the flap, urging it radially inward toward the centre of the cap 1. The cap 1 moves down the cask and the flaps 15 gradually move over a hoop H near the end of the cask C (optionally the end hoop) on which the cap 1 is being installed. The distal (free) end of each flap 15 moves over the outer surface of the cask C and eventually crosses the lower end of the hoop H on the cask, as the cap 1 is pushed further over the end of the cask, so that the distal end of the flap 15 axially traverses over the bottom part of the hoop H, at which point, the resilient bias on the flap 15 urges it radially inward relative to the hoop H, so that the distal end of the flap 15 hooks underneath the hoop H on the cask C, thereby retaining the cap 1 in place on the end of the cask as shown in FIG. 9. The hoop H that engages the flaps 15 is optionally the hoop on the outer surface of the cask C that is nearest the end of the cask C on which the cap is being applied, but this is not necessarily the case in all examples of the invention, and in certain examples, the flaps 15 can optionally engage with the second or third hoop, depending on the dimensions of the cask C.

Optionally separate casks C can be stacked end-on-end, with the cap 1 disposed between two adjacent casks C in a stack. The weight of the cask C above the cap 1 helps to press the cap 1 onto the cask C below, and helps to contain fluids within the space between the cap 1 and the end of the cask C. Optionally casks C can be stacked in arrays of 5-10 casks, depending on the size of the cask C, thereby facilitating the efficient use of warehouse space.

Each flap spaced around the circumference of the flange 13 engages its distal end underneath the hoop H at approximately the same axial location as the cap 1 is being pushed onto the end of the cask C. Engagement between the flaps 15 and the hoop H resists movement of the cap 1 without first disengaging the flaps 15 from the hoop H. Thus, the flaps 15 act as a catch to retain the cap on the cask C.

As the flaps 15 engage underneath the hoop H, the disc 30 is pushed closer to, and in this occasion, onto the end surface of the cask C. The impervious foil on the outer surface of the disc 30 facing the end of the cask C creates a barrier to the transmission of vapour through the disc 30, so fluid evaporating from the barrel cannot pass through the disc 30. The peripheral gap between the radially outer edge of the disc 30 and the circumference of the barrel leaves an annular area of the cask's uncovered end surface through which fluid from the barrel can evaporate into the space between the cask C and the inner plate of the cap 1. The surface area of the peripheral gap can be varied in different examples of the invention, and in certain circumstances, with one particular cask C, more surface area, and hence a wider peripheral gap, might be desirable. Conversely, in certain circumstances, with a different cask C, a smaller surface area, and hence a narrower peripheral gap, may be desirable. Therefore, the precise dimensions of the peripheral gap between the impervious disc 30 and the end of the cask C can be varied in different examples in accordance with the desires of the user. However, it can be seen by the skilled person that spirit evaporating from the cask C through the top of the cask C is able to diffuse more freely through the portion of the end of the cask C adjacent to the peripheral gap, than through the portion of the end of the cask covered by the impervious foil on the disc 30. Accordingly, diffusion to the top of the cask is limited by pressing the outer foil covered surface of the disc 30 against the end of the cask, and thereby closing off a portion of the surface area on the end of the cask through which the spirit can diffuse.

The degree of diffusion of spirit vapour through the cap 1 in different examples can be modified by changing the relative dimensions of the inner and outer plates 11, 30. Accordingly, if less diffusion is required, in one example, then the inner and outer plates can be only slightly different in size, with the inner plate being only slightly smaller than the internal diameter of the outer plate. However, in another example, if more diffusion of the spirit vapour is required or desired, then the inner plate can be reduced in size, so that the difference between the diameters of the inner plate and the outer plate is larger.

Any spirit vapour diffusing through the area of the end of the cask C at the peripheral gap builds up in concentration within the cap 1, which is still held on the end of the cask C by virtue of the flaps 15 engaging on the hoop H. The build-up in partial pressure of the spirit vapour in the area between the end of the cask C and the end plate of the cap 1 tends to reduce the extent of diffusion of the spirit vapour through the cask C and into the space between the end of the cask C and the cap 1. Additionally, since the material of the cap 1 is only slightly permeable, the spirit vapour concentrating in the space between the end of the cask C and the cap 1 tends to condense on the inside surface of the cap 1, forming drops on the outer plate 11, which drip onto the inside surface of the disc 30. Since the inside surface of the disc 30 is also covered with foil in this example, and is similarly impervious to fluid, any drops of condensed fluid on the end plate of the disc 30 tend to roll to the peripheral gap naturally, and are reabsorbed into the top of the cask C.

Over the years of maturation, the disc 30 will reduce the extent to which spirit vapour diffuses from the end of the cask C. Over time, the spacers 40, 41, may tend to deteriorate, and the disc 30 may no longer supported from the cap 1, but will instead be solely supported by the top of the cask C, but in that event, it will still perform the function of reducing the extent of diffusion of the spirit through the end of the cask C.

The cap 1 does permit a small amount of diffusion through the relatively porous material of the compressed fibreboard forming the cap 1, and thus the qualities of the maturation process need not be disturbed.

The invention claimed is:

1. A cask assembly, comprising a cask for maturation of a spirit, the cask containing a spirit to be matured within the cask, and a cap adapted to cover an end of the cask, the cap comprising a body having an outer plate and a flange extending from the outer plate, and an inner plate spaced from the outer plate, wherein the inner plate is disposed between the outer plate and the end of the cask when the cap is in place on the end of the cask, having concentric spacer members disposed between the outer plate and the inner plate, the spacer members being spaced apart from one another, and the spacer members incorporating channels to facilitate fluid transfer through the spacer members, wherein the inner plate has a smaller surface area than the outer plate, and wherein the outer plate has a larger surface area than the end of the cask, such that the inner plate leaves an annular area of the end of the cask uncovered between outside an outer diameter of the inner plate and an inner diameter of the outer plate, wherein the inner plate is pressed against the outer surface of the end of the cask, and wherein the inner plate comprises a water resistant material coating at least one surface of the inner plate, adapted to resist transfer of vapour across the inner plate, and wherein the flange incorporates a collar fixed to the body, and reinforcing the flange, wherein the collar comprises a plurality of segments connected together by hinges and wherein each segment is pivotally movable about a hinge relative to an adjacent segment, wherein the flange comprises a plurality of flange segments arranged sequentially around the circumference of the outer plate and extending from the outer plate, wherein the flange segments are formed integrally with the outer plate, and hingedly attached to the outer plate, wherein adjacent flange segments are connected to contiguous parts of the circumference of the outer plate, so that bending adjacent flange segments through 90° relative to the outer plate forms a continuous perpendicular flange, wherein each flange segment has a first portion and a second portion, the first portion of the flange segment being connected to the circumference of the outer plate and the second portion of the flange segment being connected to the first portion by the hinge such that the second portion of the flange segment can pivot around the hinge relative to the first portion of the flange segment, and wherein the collar is disposed between the first and second portions of the flange segment.

2. A cask assembly comprising a cask adapted for maturation of a spirit and a cap adapted to cover an end of the cask, the cap comprising:

a body having an outer plate and a flange extending from the outer plate, and an inner plate spaced apart from the outer plate by at least one spacer disposed between the outer plate and the inner plate, wherein the inner plate is disposed between the outer plate and the end of the cask and is pressed against a first area on an outer surface of the end of the cask when the cap is in place on the end of the cask, wherein the inner plate comprises a water resistant material adapted to resist transfer of vapour across the inner plate, wherein a surface area of the inner plate pressed against the first area on the outer surface of the end of the cask is smaller than a surface area of the end of the cask, wherein the inner plate leaves a peripheral gap between a radially outer edge of the inner plate and a circumference of the end of the cask such that a second area of the end of the cask is not covered by the inner plate, wherein fluid within the cask can evaporate more freely through the second area than through the first area of the end of the cask, and wherein the cap permits a limited amount of vapour transport through the material of the cap.

3. A cask assembly according to claim 2, wherein the spacer comprises at least two spacer members and wherein the spacer members are spaced apart from one another.

4. A cask assembly according to claim 3, wherein the spacer members comprise partially annular components which are arranged concentrically.

5. A cask assembly according to claim 2, wherein the spacer incorporates at least one channel adapted to facilitate fluid transfer through the spacer.

6. A cask assembly according to claim 2, wherein the second area of the end of the cask comprises an annular ring radially outside the outer diameter of the inner plate.

7. A cask assembly according to claim 2, wherein the flange comprises a plurality of flange segments extending from the outer plate, wherein the flange segments are attached to the outer plate by a hinge, so that the flange segments are adapted to bend at the hinge between a planar configuration relative to the outer plate into a perpendicular configuration relative to the outer plate.

8. A cask assembly as claimed in claim 2, wherein the cap has a retainer mechanism comprising a catch adapted to cooperate with a hoop on the outer surface of the cask adapted to retain the cap on the end of the cask; wherein the retainer mechanism comprises a number of flaps connected to the flange, and spaced around the circumference of the cap; wherein the flaps of the retainer mechanism are connected to the flange by a hinge allowing pivotal movement of the flaps of the retainer mechanism relative to the flange.

9. A cask assembly as claimed in claim 8, wherein the flange comprises a plurality of flange segments extending from the outer plate, wherein each flange segment has a first portion and a second portion; wherein the retainer mechanism comprises a flap cut from the second portion of the flange segment, wherein the flap is resiliently biased relative to the flange, in a radially inward direction relative to the cap.

10. A cask assembly as claimed in claim 2, wherein the at least one spacer creates an empty space between the opposing surfaces of the inner and outer plates.

11. A cask assembly as claimed in claim 2, wherein the water resistant material is coated on a portion of the inner plate.

12. A cask assembly as claimed in claim 2, wherein the water resistant material is coated on an first surface of the inner plate, wherein the upper surface faces the outer plate.

13. A cask assembly as claimed in claim 2, wherein the water resistant material is coated on a second surface of the inner plate, wherein the second surface is pressed against the first area on an outer surface of the end of the cask when the cap is in place on the end of the cask.

14. A cask assembly as claimed in claim 2, wherein the inner plate has first and second surfaces on opposed faces of the inner plate, and wherein the first and second surfaces are each coated with the water resistant material.

15. A cask assembly as claimed in claim 2, wherein the at least one spacer comprises a porous material permitting passage of vapour and other fluids through the spacer.

16. A cask assembly as claimed in claim 2, wherein the spacer comprises a plurality of corrugations on at least one surface.

17. A cask assembly comprising a cask adapted for maturation of a spirit and a cap adapted to cover an end of the cask, the cap comprising:

a body having an outer plate and a flange extending from the outer plate, and an inner plate spaced apart from the outer plate by at least one spacer disposed between the outer plate and the inner plate, wherein the inner plate is disposed between the outer plate and the end of the cask and is pressed against a first area on an outer surface of the end of the cask when the cap is in place on the end of the cask, wherein the inner plate comprises a water resistant material adapted to resist transfer of vapour across the inner plate, wherein a surface area of the inner plate pressed against the first area on the outer surface of the end of the cask is smaller than a surface area of the end of the cask, wherein the inner plate leaves a peripheral gap between a radially outer edge of the inner plate and a circumference of the end of the cask such that a second area of the end of the cask is not covered by the inner plate, wherein fluid within the cask can evaporate more freely through the second area than through the first area of the end of the cask, wherein the cap permits a limited amount of vapour transport through the material of the cap, wherein the cap has a retainer mechanism comprising a catch adapted to cooperate with a hoop on the outer surface of the cask to retain the cap on the end of the cask.

18. A cask assembly as claimed in claim 17, wherein the retainer mechanism comprises a plurality of flaps connected to the flange, and spaced around the circumference of the cap and wherein the flap of the retainer mechanism is connected to the flange by a hinge allowing pivotal movement of the flap of the retainer mechanism relative to the flange.

19. A cask assembly as claimed in claim 18, wherein the at least one spacer creates an empty space between the opposing surfaces of the inner and outer plates.

20. A cask assembly as claimed in claim 19, wherein the inner plate has first and second surfaces on opposed faces of the inner plate, and wherein the first and second surfaces are each coated with the water resistant material, and wherein the at least one spacer comprises a porous material permitting passage of vapour and other fluids through the spacer.

* * * * *